US005736694A

United States Patent [19]

Ketoviita

[11] Patent Number: 5,736,694

[45] Date of Patent: Apr. 7, 1998

[54] METHOD FOR PROVIDING A PHONE ALARM CALL IN AN ELEVATOR SYSTEM

[75] Inventor: Seppo Ketoviita, Hyvinkää, Finland

[73] Assignee: Kone Oy, Helsinki, Finland

[21] Appl. No.: 515,969

[22] Filed: Aug. 16, 1995

Related U.S. Application Data

[63] Continuation-in-part of Ser. No. 165,597, Dec. 13, 1993, Pat. No. 5,445,245.

[30] Foreign Application Priority Data

Dec. 22, 1992 [FI] Finland ..... 925842

[51] Int. Cl.[6] ..... B66B 1/34

[52] U.S. Cl. ..... 187/391; 187/247

[58] Field of Search ..... 187/391, 393, 187/394, 247, 390

[56] References Cited

U.S. PATENT DOCUMENTS

| | | | |
|---|---|---|---|
| 3,883,695 | 5/1975 | Bickel et al. | 179/5 R |
| 3,973,648 | 8/1976 | Hummert et al. | 187/29 R |
| 4,431,086 | 2/1984 | Moser et al. | 187/29 R |
| 4,697,243 | 9/1987 | Moore et al. | 364/513 |
| 4,771,865 | 9/1988 | Hinderling | 187/130 |
| 4,823,914 | 4/1989 | McKinney et al. | 187/133 |
| 5,007,506 | 4/1991 | Suzuki et al. | 187/101 |
| 5,064,026 | 11/1991 | Nagata et al. | 187/130 |
| 5,131,508 | 7/1992 | Suzuki | 187/132 |
| 5,345,046 | 9/1994 | Rynaski et al. | 187/105 |
| 5,445,245 | 8/1995 | Ketoviita | 187/391 |

FOREIGN PATENT DOCUMENTS 222 642 6/1990 United Kingdom .

OTHER PUBLICATIONS

Patent Abstracts of Japan, vol. 17, No. 2 (M-1348) 5 Jan. 1993 & JP-A-42 035 881 (Toshiba Corp.) 24 Aug. 1992. *abstract* Hiroshi Kitatani.

Patent Abstracts of Japan, vol. 16, No. 181 (M-1242) 30 Apr. 1992 & JP-A-40 020 465 (Toshiba Corp) 24 Jan. 1992. *abstract* Yoshitaka Azuma.

Patent Abstracts of Japan, vol. 14, No. 224 (M-0972) 11 May 1990 & JP-A-20 056 391 (Mitsubishi Electric Corp.) 26 Feb. 1990 *abstract* Hidenori Watanabe.

*Primary Examiner*—Robert Nappi

*Attorney, Agent, or Firm*—Birch, Stewart, Kolasch & Birch

[57] ABSTRACT

A system for regional and local supervision and monitoring of elevator equipment, that includes a modular system containing a service center set of equipment and an on-site set of equipment connected to at least one building. Communication between these sets of equipment is implemented using a remote communication link. A connection from an elevator car to a service center and from a service center to an elevator car is provided through the on-site equipment. A connection between an elevator car and a preselected service point can be established by the on-site equipment.

7 Claims, 5 Drawing Sheets

FIG. 4

METHOD FOR PROVIDING A PHONE ALARM CALL IN AN ELEVATOR SYSTEM

This application is a continuation-in-part of application Ser. No. 08/165,597 filed on Dec. 13, 1993 now U.S. Pat. No. 5,445,245 issued Aug. 29, 1995, the entire contents of which are hereby incorporated by reference.

BACKGROUND OF THE INVENTION

1. Field of Invention

The present invention relates to a system for regional and local supervision and monitoring of elevator equipment.

2. Description of Related Art

An example of previously known technology disclosed in U.S. Pat. No. 3,973,648, which presents an apparatus for monitoring elevator groups by means of a central computer and a modem link. The central computer selects an elevator group, which then returns digital data in serial form about events relating to the operation, disturbances and alarms in the elevator group. For communication between the elevator group and the central computer, the apparatus is provided with a hardware interface used for monitoring and transmission.

A drawback of the above described system is that the data transmitted is in an undecoded form. The central computer must decode the received data and decide whether the decoded information has resulted in service operations. For the transmission of up-to-date data to the central computer, rented communication lines have to be reserved for a long time and a great amount of computer time is required. Another drawback is that the central computer calls the elevator groups to be monitored. Therefore, the information is not obtained at the instant it is generated but only after a delay depending on the inquiry period. Additionally, at least during periods of a low traffic volume, it is possible that no events are registered.

For the installation of the car equipment, several car cable wires between the elevator car and the telephone interface unit placed in the machine room are needed for voltage supply, signal light control, monitoring of switches and push buttons and for the control of the speaker and microphone. Most car cables, especially those of old elevators, do not have a sufficient number of extra wires in well-protected conductor pairs. It is therefore necessary to install a new car cable which meets the requirements of the connection.

SUMMARY OF INVENTION

In the solution of prior problems in the art, according to the present invention, this is implemented by using a procedure in which the data transmission between the machine room and the elevator car is effected by means of only one conductor pair, which is used for the transmission of both the electricity needed by the car unit and the control and audio signals. The system has a high immunity to noise and requires no special cables, the wires in the existing car cable can be used for the data transmission. The remote monitoring hardware of the elevator generally consists of a modem/control unit which is placed in the machine room and reacts to the car alarm button being pressed, calls a service point and establishes a voice connection between the passenger who activated the alarm and the serviceman. In some cases, several elevators can be connected to the same monitoring unit if they have a common machine room.

Remote Elevator Monitoring System

The Remote Elevator Monitoring system is divided into three levels. Level I comprises the monitoring and voice connection equipment for the car alarm button; level II comprises level I+ filtering of wanton use, a system for monitoring elevator failures and other vital elevator events. Level III=level I+high=level elevator monitoring system. The Remote Elevator Monitoring system comprises two subsystems: service center equipment placed in the service center, and on-site equipment placed at the site of installation in the buildings where elevators are to be monitored. Communication between the on-site and service center equipment occurs via the common telephone network. One receiver can serve hundreds of on-site equipments.

The invention provides the following advantages:

Replaces the new car cable and its installation that would otherwise be needed in most cases.

Requires no expensive special cable.

The control/detection of all functions associated with the car, alarm button, signal lights, switches, speakers and microphone, is implemented locally, without long wiring.

All communication occurs via a single conductor pair. No additional cables are needed when new car unit functions are introduced.

The system has a very high immunity to noise, especially common-mode type noise, and therefore does not require the use of a protected special cable.

The required power is supplied from the machine room, so no separate power supply is needed. The whole system, including the voice connection, works even during a power failure.

DESCRIPTION OF PREFERRED EMBODIMENTS

Figure 1:
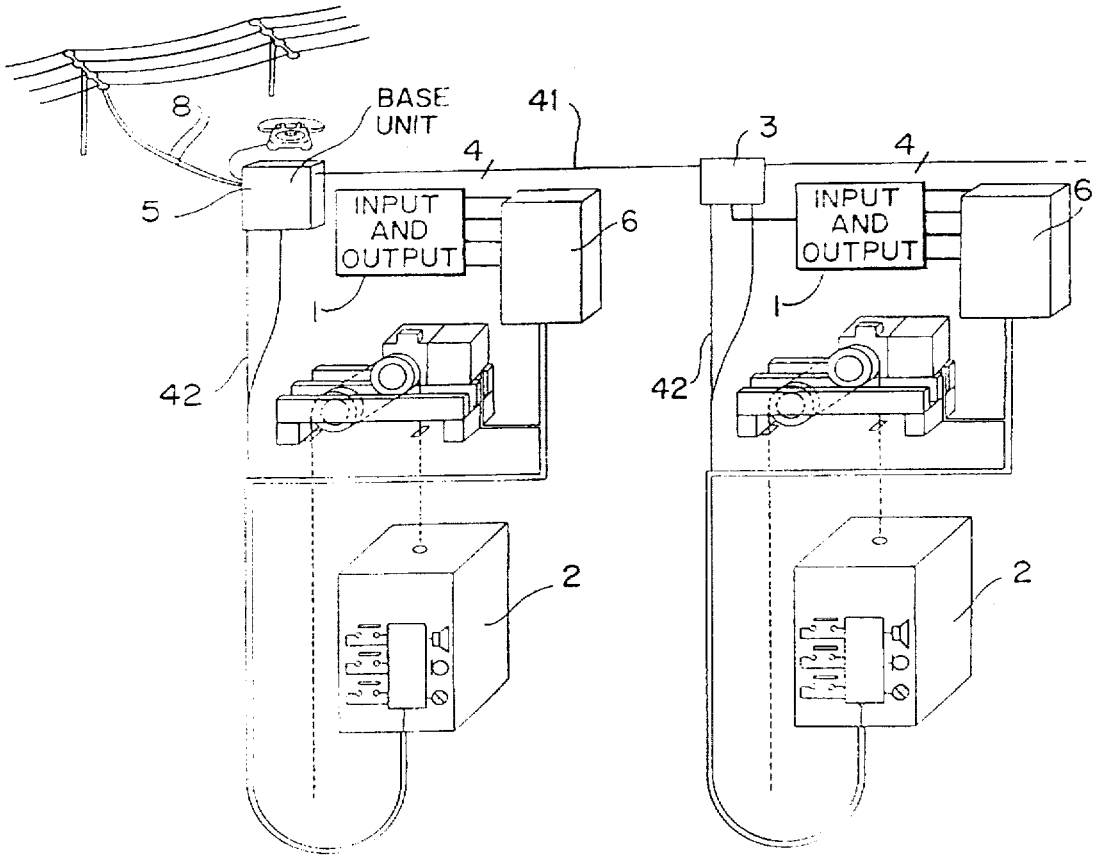
FIG. 1 illustrates the on-site equipment.

FIG. 1 illustrates the on-site equipment. It consists of four main parts, one of which is the base unit 5, depicted in detail in FIG. 2. It has several indicator devices showing the status of the equipment. An optional accessory is a keypad/display, which can be used to indicate device status in detail or for configuration. A car interface for the first car is included in the base unit 5. Normally, the base unit 5 is placed in the machine room of the elevator.

A car interface unit 3 is needed when several car units 2 are connected to the base unit 5. The connections between the base unit 5 and the car interface units 3 are implemented using a four-wire cable 41. The car unit 2 is placed in the elevator car. It contains the electronics required for the audio and data communication and receives its power via a two-wire connection 42. Element 6 is a control unit for each elevator.

An input/output (I/O) unit 1 is normally placed in the elevator machine room. The I/O unit 1 has digital inputs and outputs to be used in a level II system described above. Indicators show the status of each input and output. A car interface unit 3 for connecting a car unit 2 is integrated in the I/O unit. As an option, the equipment can be provided with a keypad/display, which is used to show status details or to configure the device. The I/O unit 1 is also provided with indicators for simple status data:

communication failure technical failure not reported technical failure emergency call (input)

valid emergency call (output) and if an auxiliary power supply has been installed:

power supply (main or battery)

battery voltage low

Optionally, the I/O unit 1 may also be connected to an intelligent keypad/display when the I/O unit 1 is not mounted in the same location (machine room) as the base unit. The keypad/display is operated via menus. All texts are in the local language.

The alarm button may be either a zero potential or an alarm button in an existing alarm bell circuit. By selection, it can be a NC (normally closed) or a NO (normally open) type contact. The alarm bell circuit may be supplied with a voltage of 6–48 VAC/DC. For the alarm and listened-to lights, efficient LED types with a maximum current consumption of 2 mA must be used. Each LED is connected to the car unit with two wires. Optionally, one or two relays can be mounted for the connection of lamps requiring more current, supplied from an external power source. The loudspeaker and microphone to be used for voice communication are delivered with the car unit 2.

Figure 2:
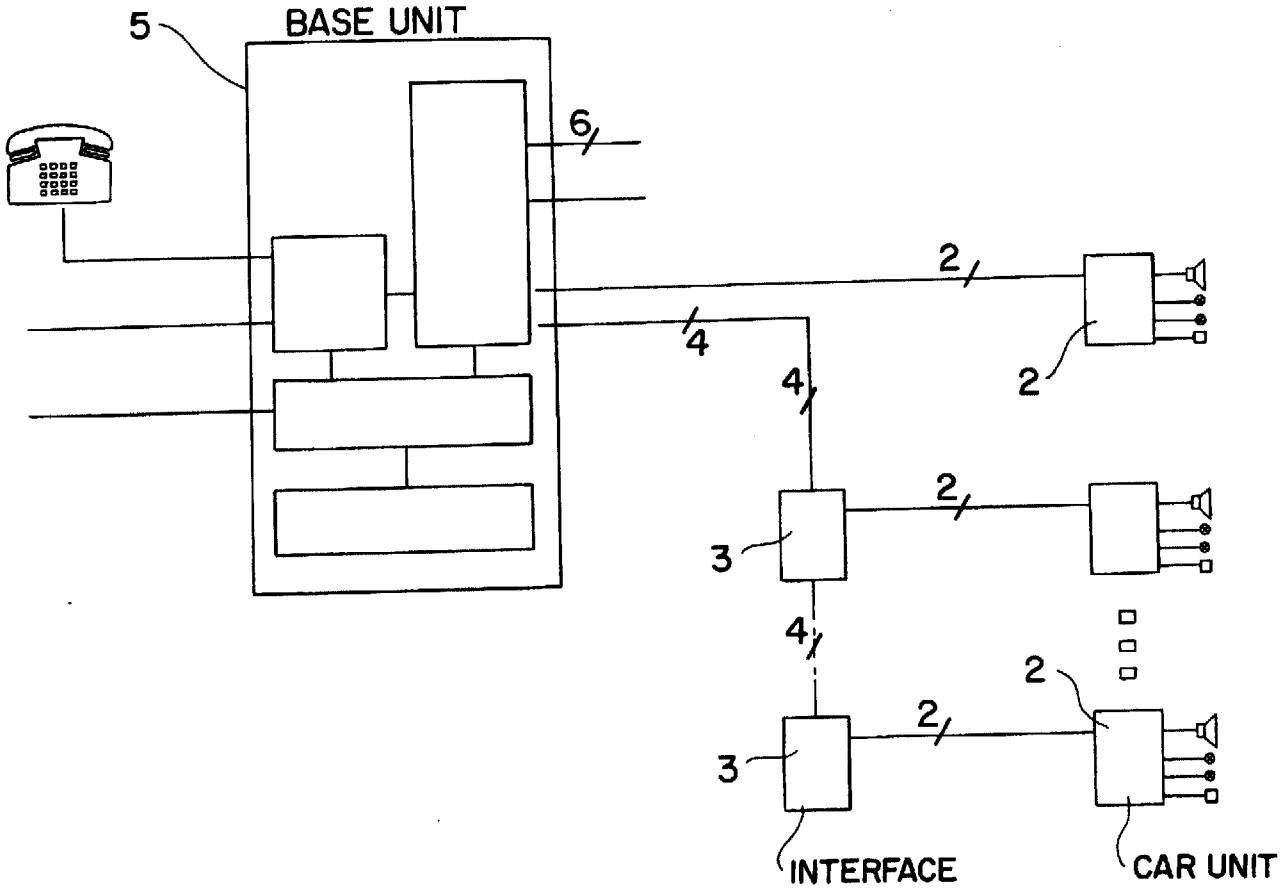
FIG. 2 illustrates the operation of the base unit.

FIG. 2 illustrates the operation of the base unit 5. Each base unit 5 can handle 8 elevators in one building or groups of buildings. The on-site equipment allows the use of a four wire cable of a length of 1000 m between the base unit and the car interface units 3 (or I/O units 1). The two wire cable between the car unit 2 and the elevator machine room unit (base unit 5, car interface unit 3 or I/O unit 1) may be up to 300 m long. The on-site equipment and the receiver 20 have a back up power supply allowing at least eight hours of stand-by operation. The car unit 2 contains a user interface, comprising a push button, two lamps (LEDs), one microphone and one loudspeaker. The push button is used to start an emergency call, one of the lamps indicates the status of the emergency call and the other the 'car listened to' status. The microphone and the loudspeaker are used for voice communication after a connection to the service center has been established. The 'car listened to' light is lit when the microphone is on. The base unit 5 has indicators for simple status data:

power supply (main or battery)

telephone line failure battery voltage low call in progress system failure (e.g. in the internal communication network).

Optionally, the base unit 5 may also be connected to an intelligent keypad/display for the input of additional status information and for configuration of the on-site equipment. For data communication between the base unit 5 and the intelligent keypad/display, the same protocol is used as on the telephone line.

Figure 3:
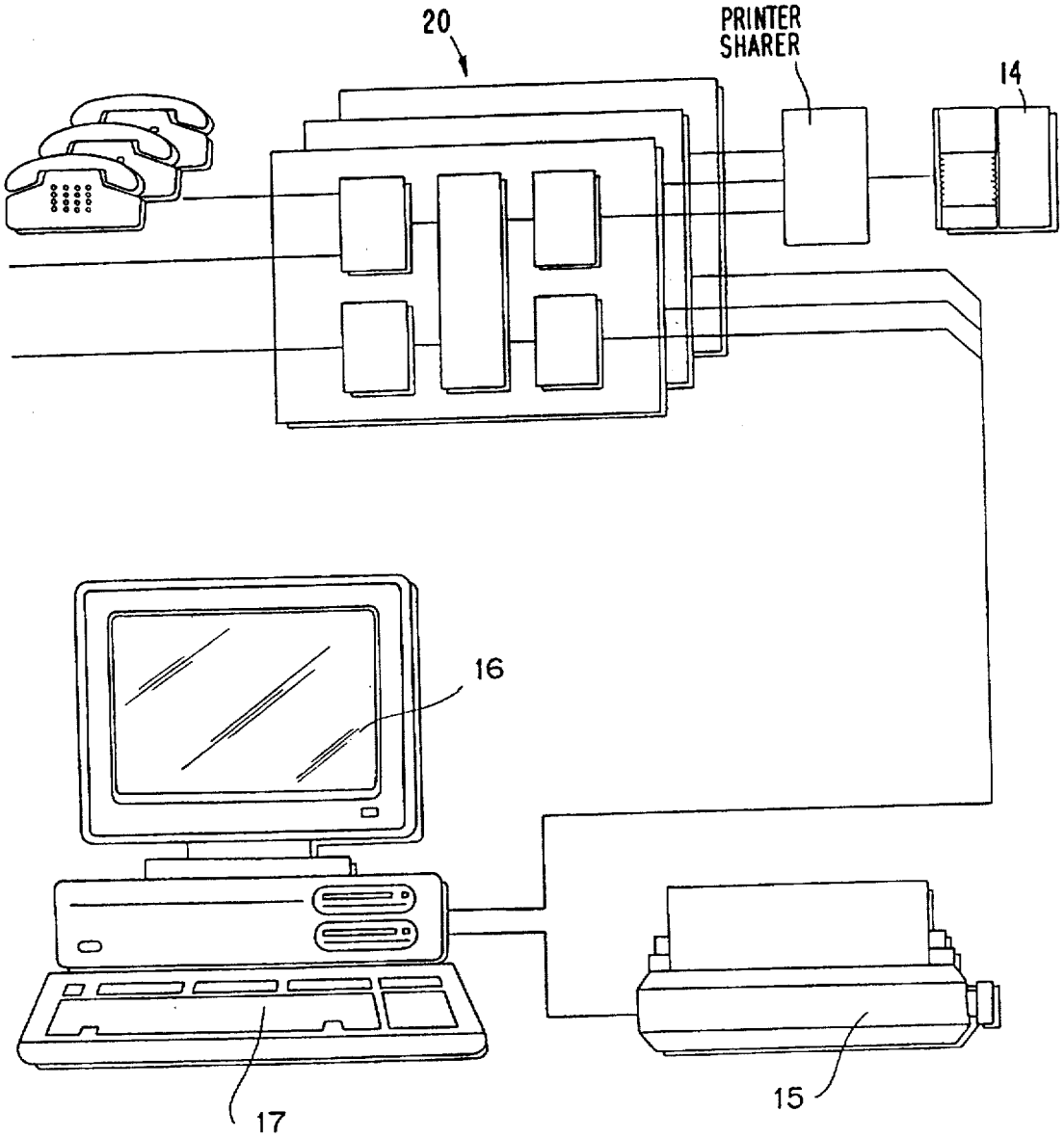
FIG. 3 illustrates the service center equipment.

FIG. 3 illustrates the service center equipment. The receiver 20 is regarded as a normal office machine and is placed on a table or in a cabinet. The receiver 20 is a closed unit with two cables, one of which connects it to the telephone network, the other to the electrical network. The cabinet can also accommodate a battery.

Moreover, the receiver 20 is provided with interfaces for the connection of a log printer, a computer 16 and an operator's telephone. The computer 16 has a testing program used for the installation. After the installation has been completed, the normal operating program can be started. Element 17 is the computer keypad. The servicing and maintenance of the on-site equipment is taken care of by the normal elevator service personnel. The on-site equipment must be so designed that it requires no servicing except for the following checks:

Testing of battery condition and change of battery when necessary.

Control of transmission (data and voice) by testing each push button of the elevator car.

Visual inspection of the equipment.

The receiver 20 has its own internal backup power supply allowing eight hours of operation without main supply power. The receiver 20 is provided with a switch and a lamp indicating whether the service center receiver 20 is unmanned.

The receiver 20 has automatic testing functions and corresponding visual indicators for the following purposes:

main or battery supply battery voltage low telephone line failure internal failure PC not connected log printer not connected In a stand-by mode, all incoming calls together with the text information received and the time of reception are printed out via the log printer. The same printer can be used as a common output device for a maximum of four receivers 20 by using an external printer sharing device. The printer and the sharing device must be powered from a separate backup power supply. Each incoming call is saved in a file on a hard disk in the computer 16 and printed out via a printer 15 (if connected). Each call is associated with a time and a status flag indicating whether a message has been printed out or not. The various types of calls can be selected for display. The selected incoming calls are displayed on the monitor screen with all the text information received and with the information added by the service center, including the time of reception. The address data can be omitted if desired. When several emergency calls are received from the same base unit 5, it is possible to select one of these for normal voice communication, or to select wireless transmission of a voice message to all the elevators from which an emergency call has been received. The system also comprises a function which triggers a call back from the on-site equipment. When a call back received from a given on-site equipment is detected, various commands can be selected from a menu:

a) to obtain status data b) for servicing/testing purposes c) for configuration of all parameters of the on-site equipment d) to establish a voice connection e) for remote control of the I/O unit outputs.

Figure 4:
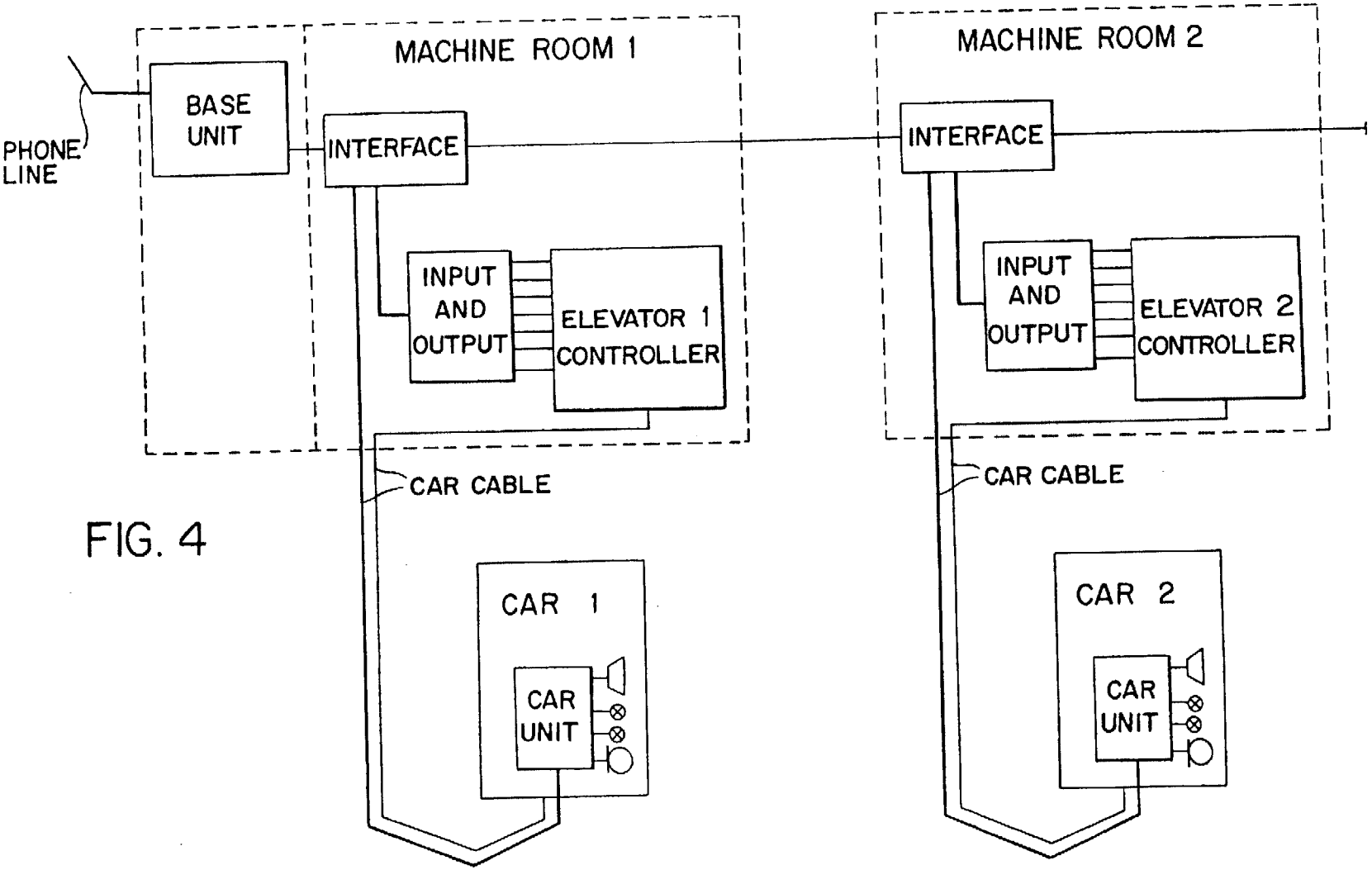
FIG. 4 illustrates the on-site equipment and elevator machine rooms.
Figure 5:
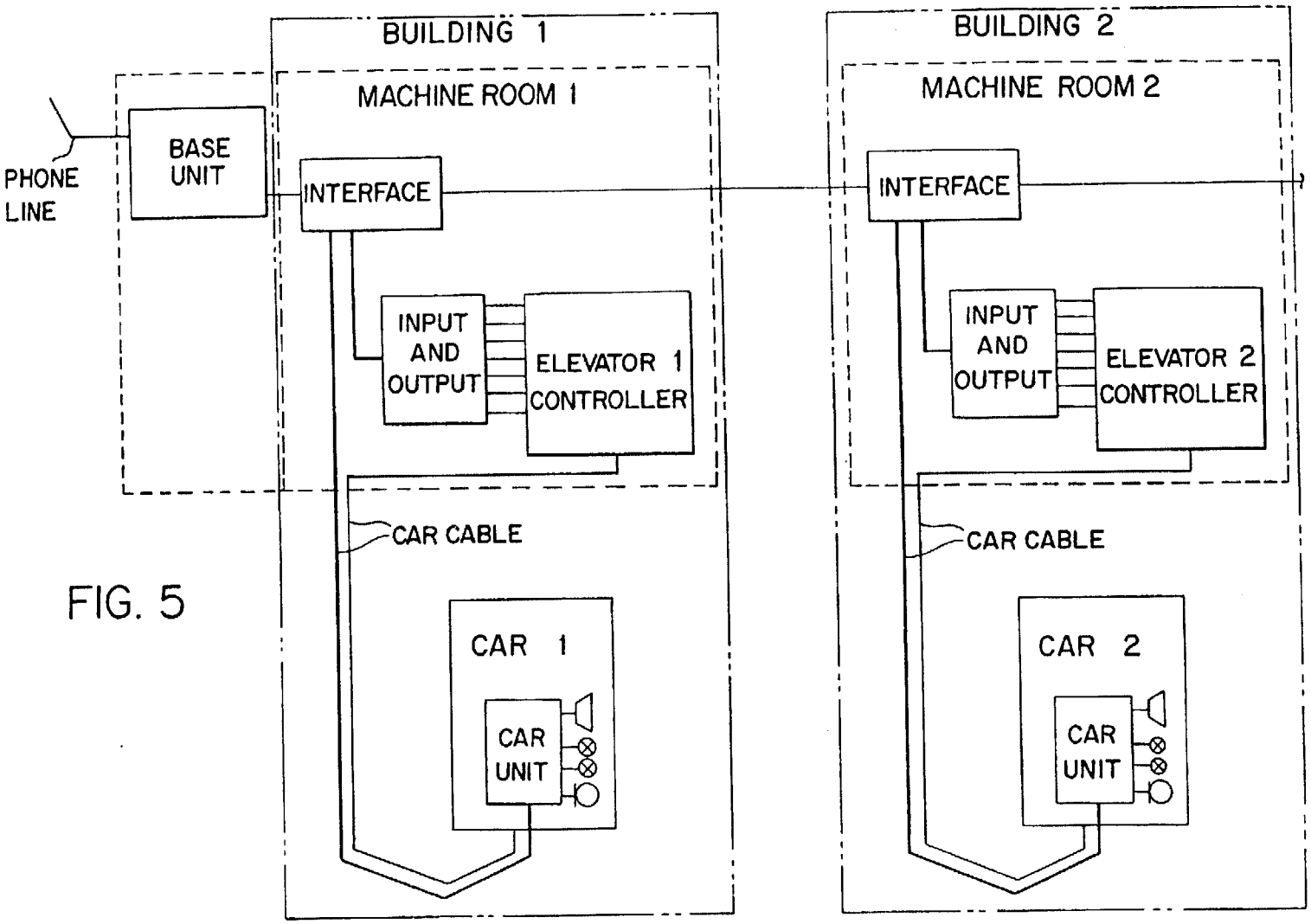
FIG. 5 illustrates the elevator cars of FIG. 4 in separate buildings. Each of the elements is shown in labeled box form for ease of understanding.

FIG. 4 illustrates two elevator cars with their associated equipment with the base unit. Each of the elements is identified in labeled box form for ease of understanding.

Functions of the Remote Elevator Monitoring system

Each elevator has its own identification code which is communicated in connection with each call. An on-site equipment can send a message to several service centers: to the main service center, at least two back-up service centers, to a programming service center and also to an ordinary telephone. The primary function of the Remote Elevator Monitoring system is to report an emergency situation. An emergency situation is created by trapped passengers by pressing the alarm button in the elevator car. The system establishes a voice connection between the trapped passengers and the service center operator. Another function of the system is to report elevator malfunctions and service needs. If an immediate service visit is not required, the need is reported in connection with a routine call. This function is included in level II equipment.

To maintain a high safety standard at each site of installation, the system performs an automatic self-test and report all disturbances found in its operation. The self-test report comprises a battery check and the absence of main power.

Each on-site equipment in the system sends regular routine calls to the service center. With the aid of this routine call, the service center monitors the on-site equipment. If the service center does not receive a routine call regularly, it can initiate a service visit to the site. This regular connection is also used for the reporting of low-priority service needs and for the transfer of certain parameters from the service center to the on-site equipment. The service center may call an on-site equipment to establish a connection for data communication for the setting of parameters or for the collection of data from the installation in question. A voice connection can be created as well.

A copy call is a copy of a message previously communicated to another service center.

The on-site equipment is used by trapped passengers and elevator service engineers who use the on-site equipment when servicing the elevators. The service center equipment is used by service center operators.

Operation of the on-site equipment

Automatic calling sequence

For each type of call, the base unit 5 establishes a telephone connection to the service center according to a phone number list. The first part of the data transmission from the on-site equipment consists of the identification code of the equipment and the call type. The call type defines the data to be transmitted. It should be possible to send several messages without interrupting the telephone connection. The service center will then answer depending on the call type.

Examples of call types 1. emergency call with voice connection
2. technical/system failure call
3. service need call
4. routine call
5. call back
6. copy call If 'routine call' is enabled, 'service need calls' will be reported in connection with the next routine call. If a call is an emergency call or a technical call, the service center answer will indicate whether the center is manned or not. If unmanned, the on-site equipment will call the next phone number in the list. If manned, a complete emergency message will be transmitted. In the case of an emergency call, voice communication will also be initiated. The voice part of an emergency call can also be transmitted to a normal telephone. This can be done in two ways. 1) The service center is called first. A message received from the service center contains the phone number to be called; or 2) The normal telephone is called first and, after a conversation, a message is sent to the service center. Other types of calls are logged by the service center equipment, to be handled by the operator immediately or later. If the purpose of a call back is to establish a connection to a service center not in the phone number list, the new callback phone number must first be down-loaded from the service center to the on-site equipment before a new call back can be initiated. Generally, the messages sent between the on-site equipment and the service center include a hand-shake to ensure that no message will be lost. Error detection is used in the transmission of all messages to ensure that correct information is sent.

Initiation of an emergency call

Pressing the alarm button in the elevator car is the normal way to initiate an emergency call. To avoid false alarms, the alarm button has to be pressed for a certain time before an emergency call is initiated. This time period is called the 'filter time'. If the alarm button is pressed and released again for a short period, the on-time is accumulated. If the button has been released for a period longer than the 'filter time', the accumulated value is reset. The time filtering is the only possible filtering in a level I system. In level II systems there are options to be configured:

a) Filtering based on digital inputs (I/O unit). Depending on one or more digital inputs, the initiation of an emergency call is only allowed if the elevator car is in an abnormal condition. The programmed 'filter time' is still valid. To allow emergency calls even when the car has stopped in a normal position, pressing the alarm button will initiate an emergency call after a 'filter time 2' period.

b) With automatic car calls (I/O unit) outputs to the elevator controller. One or two outputs can be configured for automatic car calls. When the alarm button in a car has been activated, the car call outputs are first activated in sequence to try if it is possible to bring the car to another position. If the elevator car does not respond by moving and opening the door, an emergency call will be initiated automatically. This automatic car call function is to be configured according to national regulations.

In a level II system, a special 'voice test call' is initiated if the status 'service engineer on site' exists.

Technical alarm and service call

A call can be initiated by an elevator failure or by an internal fault condition, or by internal counters or timers. In a level I system, technical alarm calls are initiated by internal failures, including 'battery voltage low', 'mains missing during a (programmable) period' and 'no response from configured car units'. In a level II system, technical alarm calls can also be initiated by using monitoring functions based on signals from the elevator controller connected to an I/O unit. Such functions can be configured individually for each elevator. The conditions are to be programmed by using a combination of softtypes (predefined behavior of a certain input type) and logical functions. The configuration possibilities include timer functions and latches. Each input can be programmed with one of the softtypes in order to achieve the desired reaction. For each input a text string can also be allocated, for easy identification.

One special function could be 'automatic car calls'. One or two outputs are configured and connected to the elevator controller. When 'automatic car call' has been activated, the car call outputs will be activated in sequence to see if it is possible to bring the car to another position. This function could also be remotely controlled from the service center. The timers can be programmed for periods ranging from a second to an hour. If a technical failure occurs, it should be possible to delay the initiation of a technical alarm call. If the car has been taken in use after the reporting of a technical failure, a cancellation report should be sent immediately.

In a level II system, service calls are initiated by elevator event counters registering 1) the number of starts, 2) the number of door closings, 3) the total running time. If car position data is available, a counter for each landing door could be configured as well.

The equipment can be configured to generate a copy call to the main service center for each message sent to a backup service center. The phone number list holds at least six phone numbers to be used for the different types of calls.

Phone number 'A' is for the main service center of the area.

Phone number 'B' and 'C' are back-up numbers for 'A'.

Phone number 'D' is for the programming center, and could be the same as 'A'.

Phone number 'E' is for routine calls.

Phone number 'F' is a normal telephone number.

Each phone number consists of a maximum of twenty-four digits, including the coding for dialing, e.g. 'wait for the tone', 'change to touch-tone dialing' or 'change to pulse dialing'. Automatic adjustment of time is included in the routine calls, synchronizing the automatic time/date setting function.

1) If 'the service center is unmanned', the next number in the sequence is selected.

If 'the service center is busy', try N times calling the same phone number.

After N failed attempts, go on to the next number.

If 'no answer from the service center, select the next number.

If 'communication with the service center in progress', try N times calling the same phone number.

2) Normally a call back will go to the programming center, but when an emergency alarm has not yet been reset and a call-back trigger is detected, the on-site equipment will send a new emergency call. This function is designed to ensure that a message from the service center can come through to the trapped passenger.

3) If 'copy call' is selected, a copy of the message sent to a backup service center will be sent to phone number 'A' (if possible).

4) If 'the service center is busy', try again after M minutes. The routine call phone number can be configured so as to allow the use of a special number. The purpose of this configuration is to make sure that the telephone line A (at the same service center) is available for emergency calls.

5) If routine call is enabled, low-priority service calls will be reported in connection with the next routine call.

6) The possibility to make a 'voice only' call to a normal telephone is to be included.

The above-mentioned calling sequence and functions may be overruled by local regulations. The system has a built-in number checking feature to filter out certain phone numbers, like 000 or 999.

The routine call includes an automatic time/date setting function to synchronize the on-site real-time clock with the service center computer time/date. This automatic time adjustment also includes a feature allowing time zone differences between the service center and the on-site equipment. Included in the on-site equipment are parameters to be configured for automatic adjusting of summer/winter time change independently of the routine call time. The system can be configured to phone to six different phone numbers:

three in the service center, receipt of the alarm calls one reserve number for the alarm calls one number for technical support, on-site system configuration etc.

check call (routine cal) number of the system

Each base unit can be configured to make the alarm call attempts freely to any service center in any order, e.g.:

row a) Call number 1; number busy; make another attempt x times; every time busy; go to row b)

row b) Call number 2; busy; make another attempt y times; busy; go to row c)

row c) Call number 3; busy; make another attempt z times; busy; go to row d)

row d) Call number 6; busy; make another attempt å times; busy; go to row a)

Redirect

When a service center is unmanned a phone number can be given to the service center, which number the base unit is wanted to call the alarm. The phone number can be given when the service man leaves the service center.

Copy call

When the main service center is not occupied the base unit sends the alarm data to the main service center, calls the next number etc. When the alarm has been serviced the base unit calls back to the main service center and informs with alarm data who served the alarm.

Report call

When the alarm call has been served by someone else than the main service center the base unit performs a rumor call to the main service center.

The base unit 5 has visual indicators for faults and status. The condition of the battery is tested every fifteen seconds. If a test fails, a service call will be initiated. A complete capacity test of the battery is not included. An automatic routine call is performed at a programmed time and interval. This function can be enabled/disabled. Information about service needs is automatically transmitted when the routine call takes place. The routine call procedure must be as short as possible to minimize the load on the service center receivers and the cost of the communication.

All programmable functions have default values in order to minimize the configuring of the individual on-site equipment. All time-dependent events, together with the time and date, are registered in an event log. The logged information can be retrieved locally or from a service center.

The event log holds the information about events in a FIFO (First-In-First-Out) buffer. Memory for at least fifty events should be reserved. All types of calls made to a service center are logged in the event log. Also events related to the base unit 5 are logged, i.e. telephone line failures, two-wire bus failures and base unit self-test failures. Each event in the event log has status field holding information about whether it has been successfully reported, is not reported or is not to be reported. The same event repeated at short intervals should not be allowed to fill the event log, but either be 'counted up' or not registered until the previous event has been reset. The status log maintains all status signals, e.g. 'emergency call', 'service engineer on site', 'elevator out of use', or 'service need'.

The status of all failures/alarms/service needs must be 'reset' when the service or check has been performed. This status log also includes event counter values relating to the previous service visit.

Text information about elevator ID, address and car position is transmitted with each call. Each elevator has its own programmable ID and address information. The ID code contains up to twenty characters, the address up to forty characters. The address part of the message can optionally be omitted. The message also includes the reason for the call and the number of trials needed to come through to the receiving receiver 20. The car position is reported on the basis of digital inputs if available (only for level II systems).

All parameters for the on-site equipment can be programmed/configured at the factory and downloaded from the service center computer via the receiver, or they can be programmed locally. When programming, whether locally or remotely, a password must be used for access to the configuration tables. The password can be changed by authorized personnel. The call-back trigger function is initiated upon detection of ringing. The no-break power supply should allow at least 8 hours of operation. The on-site equipment is expandable for handling up to 8 cars.

During an emergency call, the passengers trapped in an elevator car are continuously kept informed about the progress of the cal to avoid panic. An emergency call in progress is indicated by the ALARM lamp in the calling car and by a sound, e.g. resembling dialing tones, issued via the loudspeaker.

When a voice connection to a service center or a normal telephone has been established, a speak-mode indicator light is lit, showing that 'the car is supervised' or 'listened to' and that the microphone is connected. In broadcast mode the lamp is off.

Call back with voice is possible as the service center can always make a voice call to a car, even when the alarm button has not been activated. This possibility has been included mainly for testing purposes. The car unit and its signal lights behave exactly like in the case of an emergency call. To make a voice call to a car, the call-back function must first be triggered. A trapped passenger can repeat an emergency call by re-activating the alarm button.

When broadcast voice mode is selected by the service center operator, a broadcast voice message will be sent to all cars where an emergency call is in progress.

The data communication between the base unit 5 and the service center is implemented using an open protocol in order to provide maximum integration possibilities.

In the data communication on the two-wire line (between base unit and I/O unit), an open protocol must be used to allow the addition of new functions to levels II and III. All the commands can also be transmitted via the telephone line 8.

Via the optional keypad/display, the commands can be issued on-site.

NORMAL FUNCTIONS

- READ alarm status
- RESET alarms
- READ status of base unit
  - mains on/off
  - battery voltage too low
  - service engineer on site
  - telephone line failure
  - system failures
- READ STATUS of each elevator
  - emergency alarm
  - technical alarms/failures
  - service needs and counter values
  - elevator out of service
  - service engineer on site
  - input status (digital input)
  - output status (digital output)
- READ LOG

SERVICE FUNCTIONS

- TEST SYSTEM
- SET/RESET 'service engineer on site'
- SET/RESET 'elevator out of use'

PROGRAMMING FUNCTIONS

- SET time/date
- SET time zone parameter
- SET summer/winter time change
- SET phone numbers
- SET routine call parameters—hour/minute/interval/enable
- SET ID of base unit
- SET programming log-on code (password)
- SET default values
- SET copy call on/off and for each elevator:
- SET ID of elevator
- SET address of elevator
- SET 'filter times'
- SET input of softtypes
- SET input of text strings
- SET output of softtypes
- SET service counter limits—starts, door operations, and operation time Voice call to a normal telephone should also be possible. See section 'phone number list'. It must be possible to select between 1) calling the service center first to get the phone number and 2) calling the programmed phone number first. In voice mode, commands can be given via the telephone keypad (DTMF). At least one command is necessary for termination of voice mode. Other commands may be necessary, e.g. 'gain control', 'extend voice period', and 'acknowledge voice contact'

Full duplex communication is to be used in the system. No switch is to be used in the service center. This also gives the possibility to make a voice call from the on-site equipment to a normal telephone.

There is a maximum call time, because in some countries PTT regulations may require the termination of a call after a certain time. It should be possible to use the base unit 5 telephone for intercom connections to car units 2. This feature should at least be available in a level II system. Remote control of the outputs of the I/O unit 1 should be possible in a level II system.

The service center equipment is normally controlled by means of a computer, using its keyboard and display. The normal mode gives the best possible operator interface and allows a 'customer elevator database' to be integrated in the system. By selection, the log printer can be configured to print all received messages in normal mode.

The service center equipment can also be operated in back-up mode. This mode is automatically selected when the computer is not on-line, not running, not connected or not powered. When the equipment is operated in back-up mode, all emergency calls can still be handled and all received messages are printed out on the log printer.

The functions relating to setup/control of the receiver 20 are as follows:

- set/reset receiver
- 'unmanned' signal
- test receiver
- read status of receiver In addition, an automatic time/date update function is included.

The functions available to the operator include:

printing of the complete event log printing of certain types of calls, e.g. all routine calls received.

The receiver 20 is provided with a number of indicators showing the status of the equipment, including a sound signal telling the operator when to take action. Voice communication takes place via a telephone head/handset.

All texts in the computer are in the local language. When several alternatives are possible, help facilities and menus are available. Error messages are issued for different types of errors and failures.

The shaft wiring needed to connect the car unit is implemented with two wires by making used of the free conductors in the existing cables. Each on-site equipment can be configured at the factory, by remote control from the service center, or by using an optional keypad/display, connected either to the base unit 5 or to the I/O units 1.

The base unit 5 is mounted in the machine room close to the elevator control panel. The mounting is to be carried out using max. four screws, without removing any devices from the box. A separate mains supply cable must be provided and all local regulations relating to electrical installations must be observed.

Testing of functions can be carried out with the aim to reduce unnecessary alarms and service calls caused by malfunctioning apparatus. In addition the repairing of the smaller faults can be transferred to normal service visits.

The analysis is divided to following stages:

1. The basic analysis aims to find deviations from the normal functions on the ground of the signals When the elevator functions deviantly, the analysis often finds many different expressions of the fault, 2. Ranking of faults The system tries to find from a group of plural faults the basic fault that causes the malfunction 3. Allows the time to take care of the faults.

Depending of the fault the system waits 20 to 120 minutes if the fault is repairing by itself 4. Testing of operation If the fault seems to be permanent, a call is transmitted to the elevator and it is followed if the elevator operates normally. If the elevator does not respond to the call, it is considered that the elevator is malfunctioning and an alarm is transmitted.

The basic faults are registered in a statistic after the stage 2. If there is a fault occurring regularly and its frequency exceeds a value allowed to the elevator, a service call is made by the analyzer. The elevator is considered to function improperly and is needing a service or a repair. On the basis of a fault type the next service visit can be prepared in the service unit and the necessary spare parts can be taken with.

The discrimination of the alarm given by an alarm button is based to the same kind of tests. The function of the elevator is tested by test car call immediately after the alarm button is pressed. On the other hand if a fault has been detected before an alarm button is pressed, the press of the alarm button causes an immediate transmittance of the alarm. The status of the elevator's function is added always to the alarm messages so that service personnel in the service unit can judge the necessity of the alarm.

The function of the base unit can be tested in the similar way. The faults to be analyzed are:

communication does not succeed supply voltage is off battery is discharging.

Further after the alarm call has been transmitted and there is not voice connection with the passenger, the service unit can activate a function where a test signal is produced through the loudspeakers. Thus the operator in the service unit can hear the test signal viz the microphone and he can find if the voice system is working properly.

The system is so designed that no ground connection is needed. However, local regulations may require the use of a protective ground connection. All terminals must be screw terminals, clearly marked, easy to find and easy to work on. One or two batteries are to be installed in the base unit. The car unit 2 is placed on the outside of the elevator car, i.e. on the back of a removable car panel. The car unit is designed for flexible mounting. The printed-circuit board of the car unit is to be mounted with four screws. It is provided with separatively mounted screw terminals for the connection of a loudspeaker, microphone, LEDs, alarm button, and a two-wire bus (from the base unit).

When the on-site equipment is to be started up for the first time, an installation program specially designed for this purpose must be executed. To handle this program, the optional keypad/display may be connected to the base unit 5, or the program may be executed under remote control from the service center. The installation program is divided into two parts:

Part 1: Parameter settings

Part 2: System testing

After the above has been carried out, the system is ready for operation.

It is obvious to a person skilled in the art that different embodiments of the invention are not restricted to the example described above, but that they may instead be varied within the scope of the following claims.

I claim:

1. A method for providing a phone alarm call in response to an alarm or malfunction of data from an elevator system which includes a plurality of elevator cars in a building, or from a base unit of a plurality of elevator cars, the phone alarm call enabling at least an audible connection to be made between an elevator car and a telephone, wherein there are a plurality of phone numbers available for each elevator car or base unit; the method comprising the steps:

providing for each elevator car or base unit a phone alarm number which can receive a phone call from each elevator car or base unit;

calling in response to an alarm situation or a malfunction occurrence in an elevator car or base unit said phone alarm number in a predetermined way;

providing and calling at least one reserve number if an audible connection is not made to the phone alarm number, wherein the reserve phone number is stored in a service center; and transferring the phone alarm call to the reserve phone number by the service center.

2. The method according to claim 1, wherein said predetermined way includes calling the phone alarm number a predefined number of times.

3. The method according to claim 1, wherein the phone alarm number is in connection to a main service center and providing a data signal of the alarm to the main service center if the main service center is not able to respond to the call.

4. The method according to claim 1, including actuating an informing call, for informing the main service center of action taken after an occurrence causing the alarm has been repaired.

5. The method according to claim 3, further including the steps of:

informing the base unit that the service center is unmanned;

calling from the base unit to the service center a second time; and calling from the base unit to another service center if an audible connection is not made.

6. The method according to claim 3, including actuating an informing call for informing the main service center of action taken after an occurrence causing the alarm has been repaired.

7. In an elevator system in a building that includes a plurality of elevator cars or a base unit for controlling the plurality of elevator cars and a separate service center a method for providing an alarm phone call indicating an alarm or malfunction occurrence of the elevator system the method comprising the steps of:

providing for each elevator car or the base unit a phone alarm number for receiving a call;

providing for each elevator car or the base unit at least one reserve number stored in the service center;

calling in a predetermined way the phone alarm number in response to the alarm or malfunction occurrence; and transferring the phone alarm call to the at least one reserve number by the service center if an audible connection is not made by using the phone alarm number.

* * * * *